United States Patent [19]

Wolf et al.

[11] Patent Number: 4,938,014

[45] Date of Patent: Jul. 3, 1990

[54] FUNNEL FOR A FUNNEL SPINNING APPARATUS ON A TEXTILE MACHINE

[75] Inventors: Horst Wolf, Albershausen; Stefan Krawietz, Ebersbach/Fils, both of Fed. Rep. of Germany

[73] Assignee: Zinser Textilmaschinen GmbH, Fed. Rep. of Germany

[21] Appl. No.: 251,912

[22] Filed: Sep. 30, 1988

[30] Foreign Application Priority Data

Sep. 30, 1987 [DE] Fed. Rep. of Germany ..... 3732967

[51] Int. Cl.[5] ..... D01H 7/26; D01H 7/68

[52] U.S. Cl. ..... 57/115; 57/67; 57/352; 57/74

[58] Field of Search ..... 57/67, 127, 68, 115–117, 57/70–74, 352, 354

[56] References Cited

U.S. PATENT DOCUMENTS 4,592,196 6/1986 Wolf ..... 57/67 X

FOREIGN PATENT DOCUMENTS 0225660 6/1987 European Pat. Off. .
3400327 7/1985 Fed. Rep. of Germany .
785485 10/1957 United Kingdom .
1030853 5/1966 United Kingdom .

*Primary Examiner*—John Petrakes
*Attorney, Agent, or Firm*—Shefte, Pinckney & Sawyer

[57] ABSTRACT

A yarn feeding funnel for a textile spinning machine having an upper shaft portion and a body portion. An axial yarn passage extends through the shaft portion and an outlet passage extends from the axial passage to an opening on the surface of the body portion. The body portion has an outer surface of substantially constant inclination with respect to the axis of the funnel and of sufficient extent to substantially prevent the yarn from moving radially outwardly away from the funnel during its travel thereover.

10 Claims, 2 Drawing Sheets

FUNNEL FOR A FUNNEL SPINNING APPARATUS ON A TEXTILE MACHINE

BACKGROUND OF THE INVENTION

The present invention rleates to a funnel for a funnel spinning apparatus on a textile machine, and more particularly to such a funnel having an axial yarn feed passage and the funnel being of the type having an outlet passage connecting the yarn feed passage to the outside of the funnel.

In the operation of a funnel spinning apparatus as disclosed in German Patent No. 34 00 327, yarn is fed through a yarn feed passage into the top of the funnel and to the outside of the funnel through a radially outwardly directed outlet passage. Thereafter, the yarn travels in a spiral pattern along the outside surface of the funnel as it is wound on the bobbin below the funnel. The bobbin is cyclically moved up and down in the inside of the funnel so that a yarn buildup gradually occurs in the bobbin during the spinning of the yarn thereon. The funnel includes a conical portion and a portion above the conical portion which is rotatably mounted so that the funnel is free to rotate. The funnel also includes a generally cylindrical portion extending from the conical portion toward the lower end of the funnel.

The opening of the outlet passage on the outside of the typical funnel in on the conical portion which is rather steeply conical in shape widening downwardly in the direction of the bobbin. Also, the opening is at some distance about the interface between the conical portion and the generally cylindrical portion formed below it. Consequently, the yarn exiting the outlet passage must move radially outwardly before it overlies the generally cylindrical portion. The exiting yarn is thus subject to being forced radially outwardly away from the funnel, thereby leading to undesirable billowing or ballooning of the yarn from the funnel.

Accordingly, the need exists for a funnel for a funnel spinning apparatus of a textile machine which improves the passage of yarn thereover and which minimizes the tendency of the yarn to balloon outwardly from the funnel, especially during winding at high speed with the attendant centrifugal forces produced thereby.

SUMMARY OF THE INVENTION

The present invention provides a yarn feeding funnel for a funnel spinning apparatus of a textile spinning machine to feed yarn onto a bobbin with a minimum of ballooning and, therefore, with improved yarn control.

Briefly described, the yarn feeding funnel of the present invention includes an upper shaft portion having an axial yarn passage extending therethrough for passage of yarn therethrough, a body portion extending downwardly from the upper shaft portion an outlet passage extending from the axial passage to an opening in the body portion. The body portion has an outer surface of substantially constant inclination with respect to the axis of the funnel over an extent sufficient to substantially prevent the yarn from moving radially outwardly away from the outer surface of the funnel during its travel thereover.

In one preferred embodiment, the outer surface has an inclination with respect to the axis of the funnel of not greater than about 5 degrees.

In another embodiment, the body portion extends in a frusto-conical shape from the lower end of the outer surface.

In yet another embodiment, the outer surface is cylindrical in shape.

Other and further features and advantages of the present invention will be apparent from the accompanying drawings and the following detailed description of the preferred embodiment.

DETAILED DESCRIPTION OF THE PREFERRED EMBODIMENTS

Figure 1:
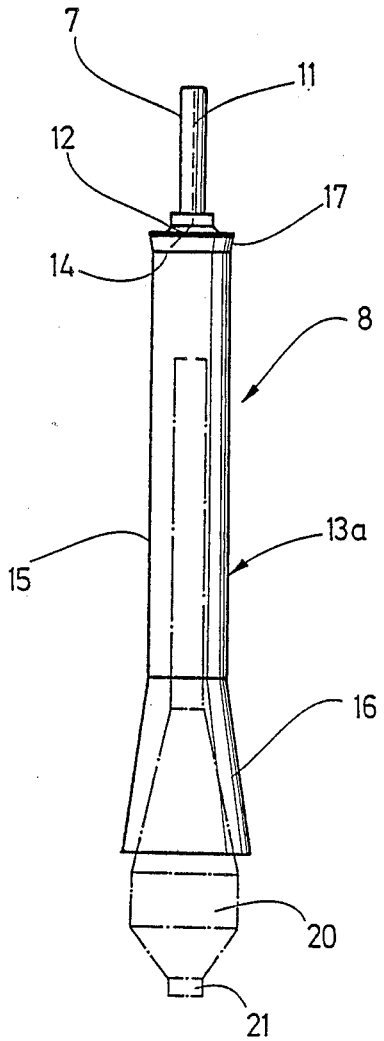
FIG. 1 is an elevational view of one preferred embodiment of the funnel of the present invention.

A funnel 8 of a preferred embodiment of the present invention for use in a funnel spinning apparatus of a textile machine is illustrated in FIG. 1. The funnel 8 encircles in non-contacting manner, the upper portion of a rotating bobbin 21 which is reciprocated vertically within and advanced out of the hollow lower end of the funnel to build a yarn package 20 on the bobbin.

The funnel 8 includes an upper shaft portion 7 having an axial yarn passage 11 extending vertically therethrough. A body portion 15, 16, 17 extends downwardly from the shaft portion 7 and includes an outlet passage 12 extending from the passage 11 to an opening 14 on the surface of the body portion. With this arrangement, the outlet passage 12 is inclined downwardly from the axial passage 11, preferably at an inclination of approximately 120° from the axis of the passage 11. The body portion extends from it upper end in frusto-conical shape 17 having a slope with respect to the axis of the funnel in the range of about 8° to 10°. The body portion extends from the frusto-conical shape 17 toward the lower axial end of the funnel to provide an outer surface **13*a* at a substantially constant inclination with respect to the axis of the funnel 8 and in a length in the range of between about 50% to 67% of the total length of the funnel. At its lower end, the body portion extends in frusto-conical shape 16 extending from the cylindrical outer surface portion 15, defining the lower axial end of the funnel flaring outwardly and downwardly. The opening 14 is in the frusto-conical shaped portion 17 of the body portion, with the frusto-conical shape 17 extnding upwardly and outwardly to a radial extent above the opening 14** greater than the radial extent of the opening.

During spinning of the package 20, the yarn passes through the axial passage 11, and the outlet passage 12 to exit through the opening 14 whereupon it travels in a spiral-like pattern about the outer surface 15 of the funnel as it is wound on the package 20. The funnel 8 spins freely in response to the winding of the yarn on the package 20 and thereby undergoes a constant angular acceleration and deceleration in response to the changing diameter of the package 20 being formed. Upon exiting the opening 14, the yarn moves radially inwardly to come into contact with the cylindrical outer surface 15, which is of lesser radial extent than the frusto-conical shape portion 17 on which the opening 14 is position. This radially inward movement of the yarn following its exit from the opening 14 helps to minimize the risk that the yarn will detrimentally billow or balloon away from the funnel 8 during the spinning process. Additionally, this risk is minimized by the passage of the yarn over the cylindrical outer surface 15 since that portion presents a surface with substantially constant axial inclination upon which the yarn can travel without experiencing a change in its inclination relative to the axis of the funnel. Moreover, since the cylindrical outer surface 15 comprises between 50% to 67% of the total length of the funnel 8, the yarn is not subjected to changes in its axial inclination during most of its travel over the funnel.

Figure 2:
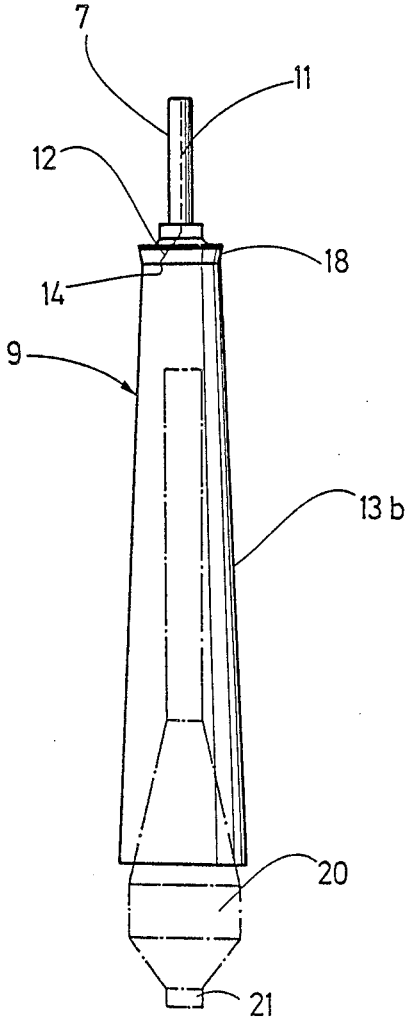
FIG. 2 is an elevational view of an alternative embodiment of the funnel of the present invention.

In FIG. 2, a funnel 9 of an alternative embodiment of the apparatus of the present invention is illustrated and has an upper shaft portion 7 and a body portion with an inverted frusto-conical shape 18 at its upper end. The frusto-conical shape 18 is inclined with respect to the axis of the funnel at an angle in the range of between about 8° to 10°. Otherwise, this embodiment is identical to the embodiment of FIG. 1 described above with the exception that the outer surface **13*b* extending downwardly from the upper frusto-conical shape 18 is slightly conical, being inclined relative to the axis of the funnel at an angle in the range of between about 2° to 4° and extending to the lower end of the body portion without a different lower frusto-conical shape. Also, the opening 14 is positioned at the juncture between the frusto-conical shape 18 and the outer surface 13*b***.

Figure 3:
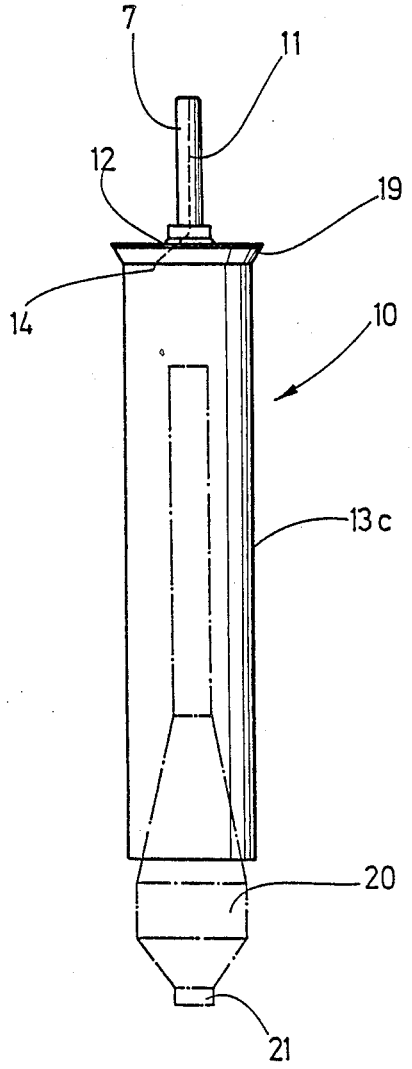
FIG. 3 is an elevational view of another alternative embodiment of the funnel of the present invention.
Figure 4:
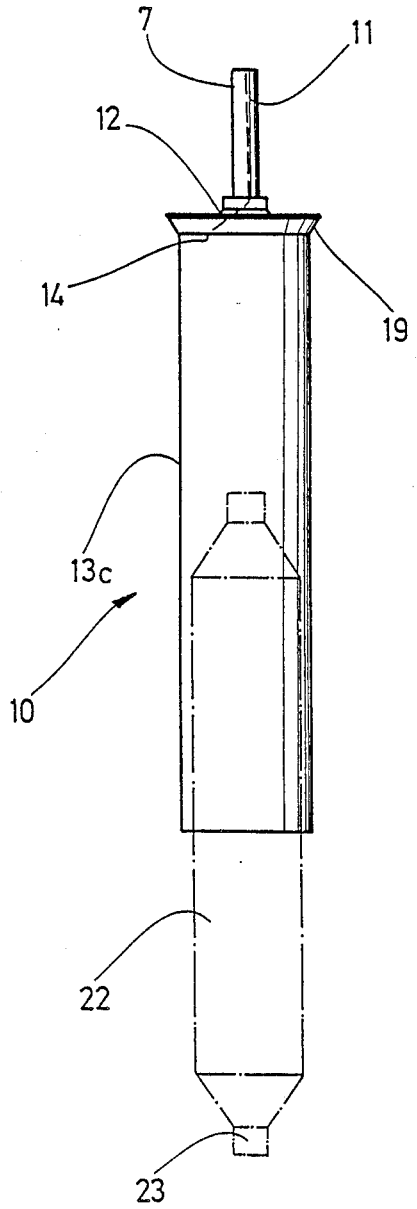
FIG. 4 is an elevational view of the funnel shown in FIG. 3, showing the funnel in use in the spinning of a bobbin having parallel windings of the type typical of roving bobbins.

FIGS. 3 and 4, a funnel 10 of another alternative embodiment of the apparatus of the present invention is shown which includes an inverted frusto-conical shape 19. This embodiment is identical to the embodiment of FIG. 2 except that the outer surface **13*c* is throughout its extent and it extends cylindrically to the lower end of the body portion. In this embodiment the opening 14 is positioned within the frusto-conical shape 19**.

In FIG. 4, the funnel 10 illustrated in FIG. 3 is shown in use in the spinning of a package 22 on a core 23. The package 22 is of the type having parallel windings, such as a roving bobbin. During this type of spinning operation, the winding speed changes gradually and the angular acceleration of the funnel 10 correspondingly gradually increases. Therefore, the funnel does not experience a pattern of angular acceleration and deceleration as does the funnel when used with a bobbin operated in a cyclical builder motion.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A yarn feeding funnel for a textile spinning machine, comprising:

an upper shaft portion having an axial yarn passage extending vertically therethrough for passage of yarn therethrough; and a body portion extending downwardly from said upper shaft portion and having an outlet passage extending from said upper shaft portion passage to an opening in said body portion and having an outer surface of substantially constant inclination with respect to the axis of the funnel, said outer surface beginning at said opening and extending from said opening over an extent of the body portion sufficient to substantially prevent the yarn from moving radially outwardly away from said outer surface during its travel thereover.

2. A yarn feeding funnel according to claim 1 and characterized further in that said body portion has an axial length at least equal to one half of the axial length of the funnel.

3. A yarn feeding funnel according to claim 1 and characterized further in that the inclination of said outer surface with respect to the axis of the funnel is not greater than about 5 degrees.

4. A yarn feeding funnel according to claims 1, 2 or 3 and characterized further in that said body portion extends in a frusto-conical shape from the lower end of said outer surface.

5. A yarn feeding funnel according to claims 1, 2 or 3 and characterized further in that said outer surface extends to the lower end of the funnel.

6. A yarn feeding funnel according to claim 5 and characterized further in that said body portion is frusto-conical in shape below said opening.

7. A yarn feeding funnel according to claim 5 and characterized further in that said outer surface is cylindrical in shape.

8. A yarn feeding funnel according to claims 1, 2 or 3 and characterized further in that said opening is radially spaced from said shaft passage.

9. A yarn feeding funnel according to claim 8 and characterized further in that said body portion extends above said outer surface to a greater radial extent than said outer surface.

10. A yarn feeding funnel according to claims 1, 2 or 3 and characterized further in that said opening is lower than the downward extent of said shaft passage.

* * * * *